US007856935B2

(12) United States Patent
Yagi et al.

(10) Patent No.: US 7,856,935 B2
(45) Date of Patent: Dec. 28, 2010

(54) TWIN SAILING BOARD

(75) Inventors: Noboru Yagi, Kyoto (JP); Toshiro Kieda, Shiga (JP)

(73) Assignees: Yugen Kaisha Country Harbour, Shiga (JP); Yugen Kaisha Yagi Seisakusho, Kyota (JP)

( * ) Notice: Subject to any disclaimer, the term of this patent is extended or adjusted under 35 U.S.C. 154(b) by 302 days.

(21) Appl. No.: 12/224,317

(22) PCT Filed: Jan. 24, 2008

(86) PCT No.: PCT/JP2008/050977

§ 371 (c)(1),
(2), (4) Date: Aug. 22, 2008

(87) PCT Pub. No.: WO2009/093320

PCT Pub. Date: Jul. 30, 2009

(65) Prior Publication Data

US 2010/0162933 A1 Jul. 1, 2010

(51) Int. Cl.
*B63H 9/00* (2006.01)

(52) U.S. Cl. ..... 114/39.12; 114/61.1

(58) Field of Classification Search ..... 114/39.12, 114/61.1, 61.15, 352; 441/74
See application file for complete search history.

(56) References Cited

U.S. PATENT DOCUMENTS 3,273,528 A * 9/1966 Kiefer ..... 114/61.24
3,473,502 A 10/1969 Wittkamp
4,437,424 A * 3/1984 Lord ..... 114/91
4,526,120 A * 7/1985 Gaide ..... 114/39.12
4,534,305 A * 8/1985 Lecomte ..... 114/43
4,730,568 A * 3/1988 Campbell ..... 114/39.14

(Continued)

FOREIGN PATENT DOCUMENTS

GB 2124157 A * 2/1984

(Continued)

OTHER PUBLICATIONS

International Search Report for International Application No. PCT/JP2008/050977; mailed Apr. 15, 2008; 3 pages; (including English translation; 3 pages).

*Primary Examiner*—Stephen Avila
(74) *Attorney, Agent, or Firm*—Foley & Lardner LLP

(57) ABSTRACT

The present invention relates to a twin sailing board characterized in including a pair of surfboards (10, 12) adjacently disposed in a lateral direction, plate-like bodies (14, 16, 18) detachably secured to the surfboards (10, 12) by a screw (26), which is screwed with a mast end securing screw (MT) being movable in front and end directions of the surfboards (10, 12) within grooves (10*d*, 12*d*) provided on respective top surfaces of the pair of the surfboards (10, 12), a rig (24) including at least a mast (24*c*), which is connected to assume any inclined attitude by an engaging portion (30) fixed at substantially center of the plate-like bodies (14, 16, 18), a sail (24*a*) being set up on the mast (24*c*), and a boom (24*b*) circularly provided on the mast (24*c*) in such a manner that the sail (24*a*) is placed inbetween, and a rod-shaped member (20) erected on the plate-like bodies (14, 16, 18) at the further front side than the mast (24*c*) and whose leading edge is provided with a first ring member (20*a*).

2 Claims, 6 Drawing Sheets

U.S. PATENT DOCUMENTS

| | | | | | |
|---|---|---|---|---|---|
| 4,993,350 | A | * | 2/1991 | Pepper | 114/292 |
| 5,024,177 | A | * | 6/1991 | Winter et al. | 114/39.26 |
| 5,410,977 | A | | 5/1995 | Webb | |
| 5,529,008 | A | * | 6/1996 | Craig | 114/61.1 |
| 5,860,378 | A | * | 1/1999 | Schaller | 114/39.11 |

FOREIGN PATENT DOCUMENTS

| | | |
|---|---|---|
| JP | 05-201383 | 8/1993 |
| JP | 09-109987 | 4/1997 |
| JP | 3054362 | 12/1998 |
| JP | 2002-370691 | 12/2002 |

* cited by examiner

TWIN SAILING BOARD

CROSS-REFERENCE TO RELATED PATENT APPLICATION

The present Application is a national stage filing under 35 USC §371 of PCT Patent Application No. PCT/JP2008/050977 titled "TWIN SAILING BOARD" filed on Jan. 24, 2008, the disclosure of which is hereby incorporated herein by reference in its entirety.

TECHNICAL FIELD

The present invention relates to a twin sailing board. More particularly, the present invention relates to a twin sailing board for windsurfing in which two surfboards are laterally coupled and having high safety due to low risk of upsetting.

BACKGROUND ART

A sailing board for windsurfing (hereinafter simply referred to as "sailing board") is provided with a mast on a single surfboard allowing the mast to assume any inclined attitude (in other words, a movement track of a leading edge of the mast assumes a substantially hemispherical plain with a fixed axis of a mast centered on). A plurality of flexible rod-shaped frames (hereinafter referred to as "batten") extending to the substantially vertical direction relative to the mast is mounted on the sailing board. One side of a sail with a substantially triangle shape is secured to the mast and the other side is inserted through a pouched batten pocket wrapping the plurality of battens. Furthermore, the mast is provided with a circularly-arranged flexible boom (i.e. steering which is operated by a user) extending from the mast to both sides of the sail by placing the sail inbetween. Since a mast can assume any inclined attitude, a sailing board is substantially different from a yacht (a mast is fixed to a hull as a cantilever). Thus, in order to turn the front of the surfboard, a user, regardless of under strong wind or slight wind, inclines the sail relative to a straight line connecting a front and end of the surfboard while supporting the sail receiving wind pressure by own weight so as not the sail to fall into the water, grabs a boom so as not the mast to fall down, and manages the skills (tacking, jibing) to incline the sail by shifting the gravity point of the user or moving to the right helm side or left helm side on the surfboard. Therefore, operation of a sailing board is more difficult than that of a yacht to the extent that even experienced users often fall down. Especially, beginners whose maneuvering skills are poor almost always fall down, are nearly drown, and drink a large amount of water or sea water. Even if a user manages to get back on a surfboard, sail up work is required. However, it is difficult for beginners to sail up while maintaining the balance of their bodies even when there is no wind, and it is almost impossible to sail up when there is strong wind. Since a mast of a sailing board can assume any inclined attitude as compared with that of a yacht, it is not possible to eliminate the possibility of falling down and the sail up work. Thus, in order to master the maneuvering, one needs to gain experience in maneuvering techniques by falling down many thousand times under fine weather as well as bad weather. However, there is a problem that beginners become frustrated due to the fear of falling down and the difficulty of sail up work. This is one of the reasons for preventing the promotion of windsurfing.

In view of the problems associated with conventional sailing boards, the inventor of the present invention has proposed to provide a cantilever rod-shaped member (a kind of a rail) on a surfboard to sail up a sail, the member being different from the mast (Japanese Patent No. 3686014).

According to the invention described in Japanese Patent No. 3686014, a rope whose one end is fixed to the sail is threaded through a ring body (direction changing member) provided on a leading edge of the rod-shaped member. A user on the surfboard can erect the sail which has fallen down on the water by holding the other end of the rope with hands and pulling the rope downward in the substantially vertical direction relative to the surfboard. Therefore, the complexity of work associated with sailing up (erecting the sail) has been reduced by a simple work (pulling a rope).

DISCLOSURE OF INVENTION

According to the prior art described in Japanese Patent No. 3686014, only the complexity of the work associated with sailing up (erecting the sail) has been reduced. However, since the fundamental problem associated with falling down of a surfboard has not been solved, the fear of drowning by falling down and being thrown into the lake or sea has not eliminated.

An object of the present invention is to provide a twin sailing board which substantially lowers the possibility of falling down and facilitates sail up work at a low cost.

According to the sailing board described in claim 1, a pair of surfboards (10, 12) adjacently disposed in a lateral direction, plate-like bodies (14, 16, 18) detachably secured to the surfboards (10, 12) by a screw (26), which is screwed with a mast end securing screw (MT) being movable in front and end directions of the surfboards (10, 12) within grooves (10*d*, 12*d*) provided on respective top surfaces of the pair of the surfboards (10, 12), a rig (24) including at least a mast (24*c*), which is pivotally coupled to assume any inclined attitude by an engaging portion (30) fixed at substantially center of the plate-like bodies (14, 16, 18), a sail (24*a*) being set up on the mast (24*c*), and a boom (24*b*) circularly provided on the mast (24*c*) in such a manner that the sail (24*a*) is placed inbetween, and a rod-shaped member (20) erected on the plate-like bodies (14, 16, 18) at the further front than the mast (24*c*) and whose leading edge is provided with a first ring member (20*a*) are included.

BEST MODE FOR CARRYING OUT THE INVENTION

Figure 1:
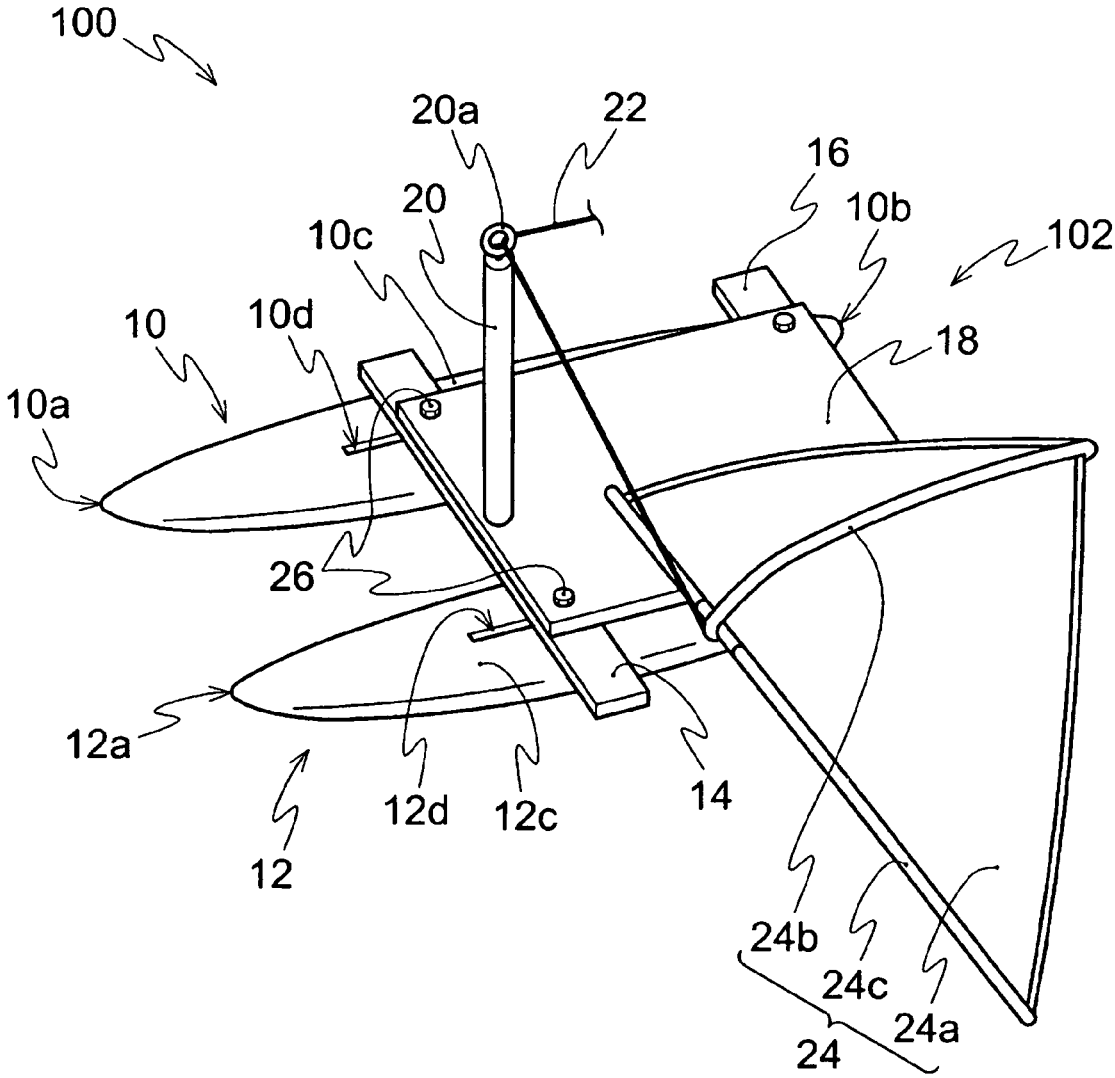
FIG. 1 is a view showing Embodiment 1 of the sailing board of the present invention.
Figure 2:
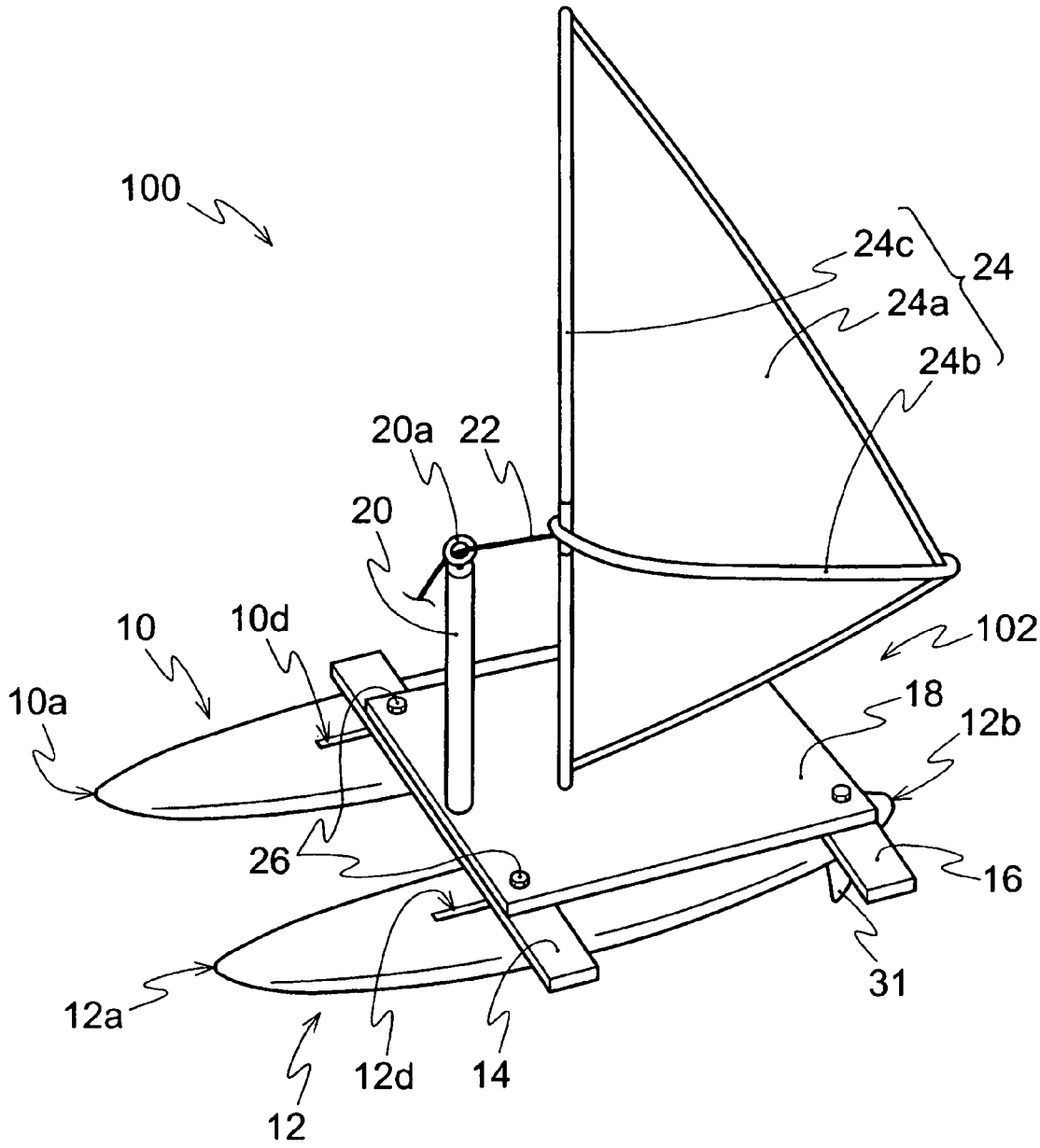
FIG. 2 is a view showing Embodiment 1 of the sailing board of the present invention.

Hereinafter, Embodiments of the present invention are explained by referring to the accompanying drawings.

FIGS. 1 to 4 show Embodiment 1 of a twin sailing board of the present invention. A twin sailing board 100 includes plate-like bodies 14, 16, 18 detachably secured to surfboards 10, 12 by a screw 26 which is screwed with a mast end securing screw MT, the mast end securing screw being movably provided in front and end directions of the surfboards within grooves 10*d*, 12*d* provided on respective top surfaces of a pair of the surfboards 10, 12 adjacently disposed in the lateral direction, a rig 24 including at least a mast 24*c*, which is coupled to assume any inclined attitude by an engaging portion 30 fixed at a substantially center of the plate-like bodies 14, 16, 18, a sail 24*a* being set up on the mast 24*c*, and a boom 24*b* circularly provided on the mast 24*c* in such a manner that the sail 24*a* is placed inbetween, and a rod-shaped member 20 erected at the further front side than the mast 24*c* and whose leading edge is provided with a first ring member 20*a*. The sailing board 100 has a coupling member 102.

The coupling member 102 includes the plate-like bodies 14, 16, 18 detachably secured to the surfboards 10, 12 by the screw 26 which is screwed with the mast end securing screw MT, the mast end securing screw being movably provided in front and end directions of the surfboards within the grooves 10*d*, 12*d* provided on respective top surfaces of the pair of the surfboards 10, 12 adjacently disposed in the lateral direction. In Embodiment 1, the plate-like bodies 14, 16, 18 include a first plate 14, second plate 16, and first plate-like member 18. However, the plate-like body may be formed from a single wooden or synthetic resin plate.

The rig 24, which is steered by a user, is detachably mounted on the first plate-like member 18.

The grooves 10*d*, 12*d* are spaces provided to mount the rig 24 on decks 10*c*, 12*c* of the surfboards 10, 12 and include a space 12*g* into which a male screw 30*b* of an engaging portion 30 for mounting the mast 24*c* can be inserted and a recess 12*f* for placing the nut MT in which the female screw which screws with the male screw 30*b* is formed.

As mentioned above, the twin sailing board 100 of the present invention includes two floating surfboards in the lateral direction. Therefore, the risk of upsetting is distinctively low and the area of the first plate-like body 18 for providing a foothold for the user in sail up work can be increased as compared to the case with a single surfboard. Thus, the user can focus on acquiring maneuvering skills of windsurfing without having the fear of upsetting or drowning and enjoy exhilarating feeling of sliding movement of a surface of a lake or sea. Furthermore, the user can easily maintain the balance of the body and calmly erect the sail 24*a* even when the sail 24*a* falls down to the water level. Therefore, the user is not frustrated to enjoy windsurfing and can steadily develop his/her skills by learning maneuvering skills even if the user is a beginner.

Furthermore, according to the present invention the first plate-like member 18 can be attached or detached to/from the decks 10*c*, 12*c* by using the grooves 10*d*, 12*d* for erecting the mast provided on the surfboards 10, 12 and the nut MT movably provided at the grooves 10*d*, 12*d*. Therefore, an inexperienced user can safely enjoy windsurfing even when sailing speed is low as compared to the case with one surfboard. On the other hand, an experienced user can enjoy regular windsurfing by detaching the first plate-like, member 18 from the decks 10*c*, 12*c* and using the member as a single board.

In this example, the first plate 14, second plate 16, and first plate-like member 18 are rectangular. However, various shapes such as circular and oval shapes can be used. As for materials used for the plates and member, any light weight materials which do not decrease the buoyancy of the surfboards 10, 12 while maintaining the required strength may be used and materials such as light metals like aluminum, synthetic resin plastic, wooden material, or chip bond may be used.

The rod-shaped body 20 is, for example, inserted into a rod-shaped member (not shown) provided on the first plate-like member 18 and erected on the first plate-like member 18. As another configuration, the rod-shaped body 20 may be directly inserted into the first plate-like body 18 and fixed thereto. The diameter of the rod-shaped body 20 is dependent on the strength of the employed material and is desirable to be approximately 20 to 50 mm in the case of an aluminum rod.

The length thereof is preferably set such that it extends between the waist and height of the user in view of feasibility of maneuvering and obstruction of sailing. Furthermore, the length is most desirably set at a position of the boom 24*b* (usually approximately the height of a user's chest) when sail up is completed.

The first ring member 20*a* through which a rope 22 is threaded is provided at the leading edge of the rod-shaped body 20. One end of the rope 22 is secured to the rig 24. The other end of the rope 22 is held by a user. Therefore, the user may pull the rope 22 when operating the rig 24 in the case the sail 24*a* falls down to the water level. In this case, the user can sail up by pulling the rope 22 downward in the vertical direction relative to the surfboards 10, 12.

When the rope 22 is wet with water, large force is required in pulling the rope 22 since the friction generated between an inside of the first ring member 20*a* and rope 22 becomes large. Accordingly, a low friction member (for example beads) may be adhered along with the inside of the first ring member 20*a* to reduce the friction.

When the user directly pulls the rope 22 by with hands, the rope 22 retracts if the user releases the rope. Therefore, the user needs to continuously, hold the rope 22 until sail up is completed. However, this becomes strain to hands and arms when considering the weight of the sail 24*a*. Therefore, the rope 22 does not desirably retract even when hands are released while performing sail up. In addition, the user may tie the rope 22 to the first ring member 20*a* after sailing up.

Figure 3:
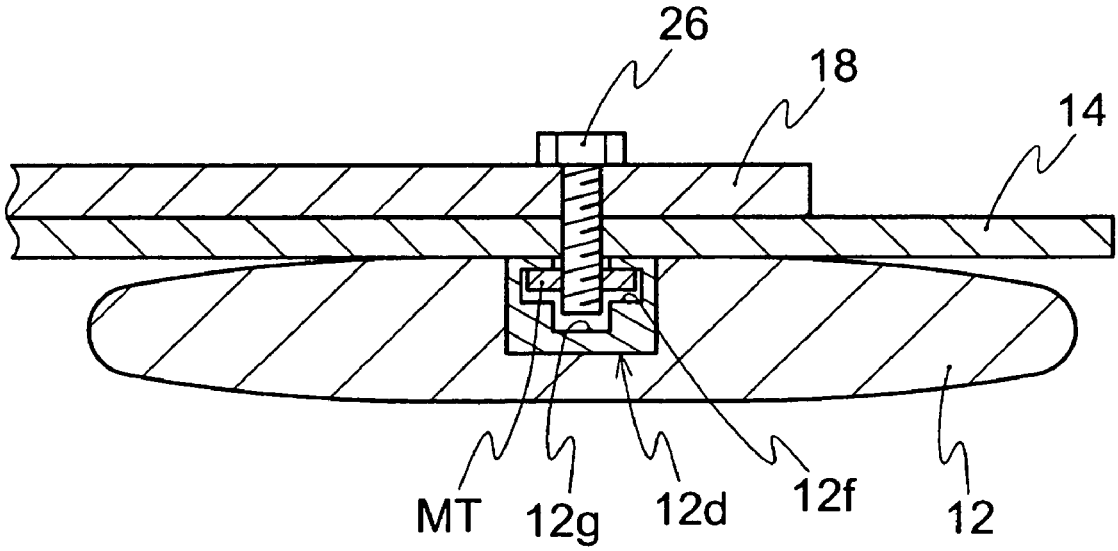
FIG. 3 is a view showing that a first plate-like member is mounted on a surfboard.

FIG. 3 shows a state in which the first plate-like member 18 of the present invention is mounted on the surfboard 12. The groove 12*d* has the nut MT. The first plate-like member 18 is mounted on the surfboard 12 by screwing the bolt member 26 through the first plate 14 and the female screw formed at the nut MT.

Figure 4:
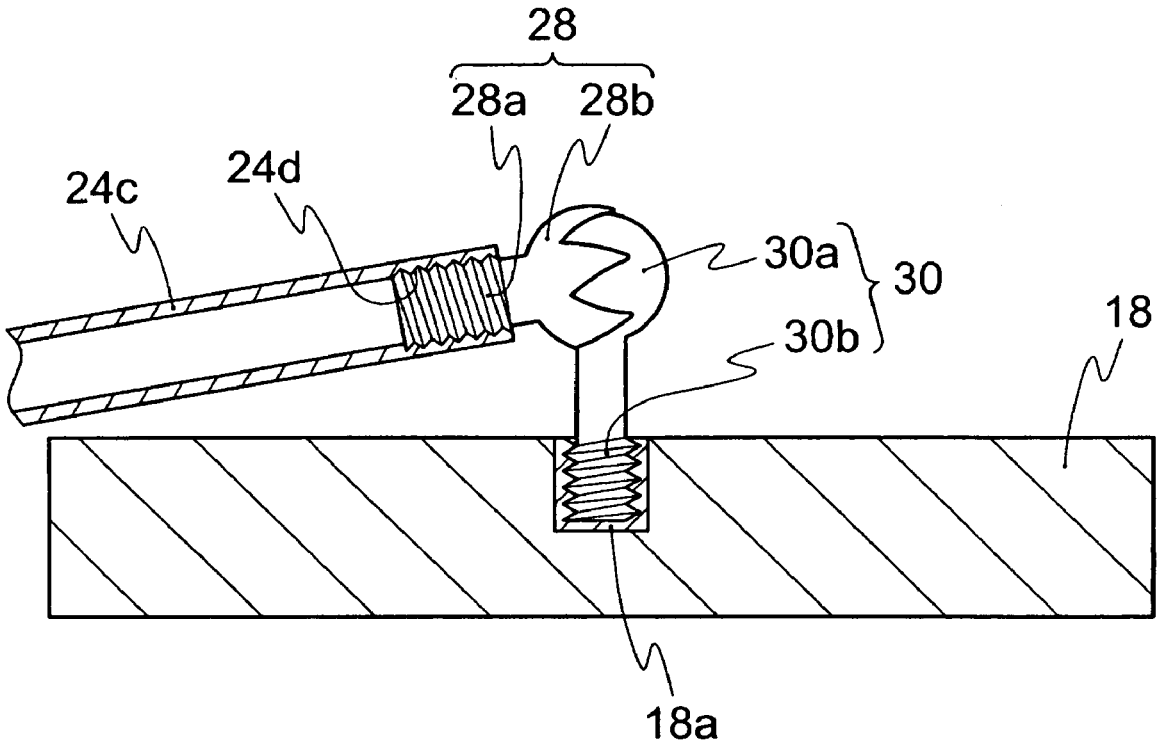
FIG. 4 is a view showing that a rig is mounted on the first plate-like member.

FIG. 4 shows a state in which the rig 24 (sail 24*a*, boom 24*b*, mast 24*c*) is mounted on the first plate member 18. In this example, the mast 24*c* is mounted on the first plate like member 18 by a locking claw 28 and engaging portion 30. The female screw 18*a* with a recessed shape is formed at the substantially center of the first plate-like member 18. The female screw 24*d* is formed on an inner circumference of an end of the mast 24*c*.

The locking claw 28 includes a bolt member 28*a* and cup-shaped member 28*b*. The bolt member 28*a* is mounted on the female screw 24*d*. The engaging portion 30 includes a spherical member 30*a* and bolt member 30. The bolt member 30*b* is mounted on the female screw 18*a*. By engaging the cup-shaped member 28*b* of the locking claw 28 with the spherical member 30*a* of the engaging portion 30, the locking claw 28 is engaged with the engaging portion 30.

With this engagement, the user can move the mast 24 in any directions with the engaging portion 30 serving as a fulcrum. As for a member for achieving such objective, a member with various shapes, configurations, and materials may be considered and it is not limited to this arrangement.

Figure 5:
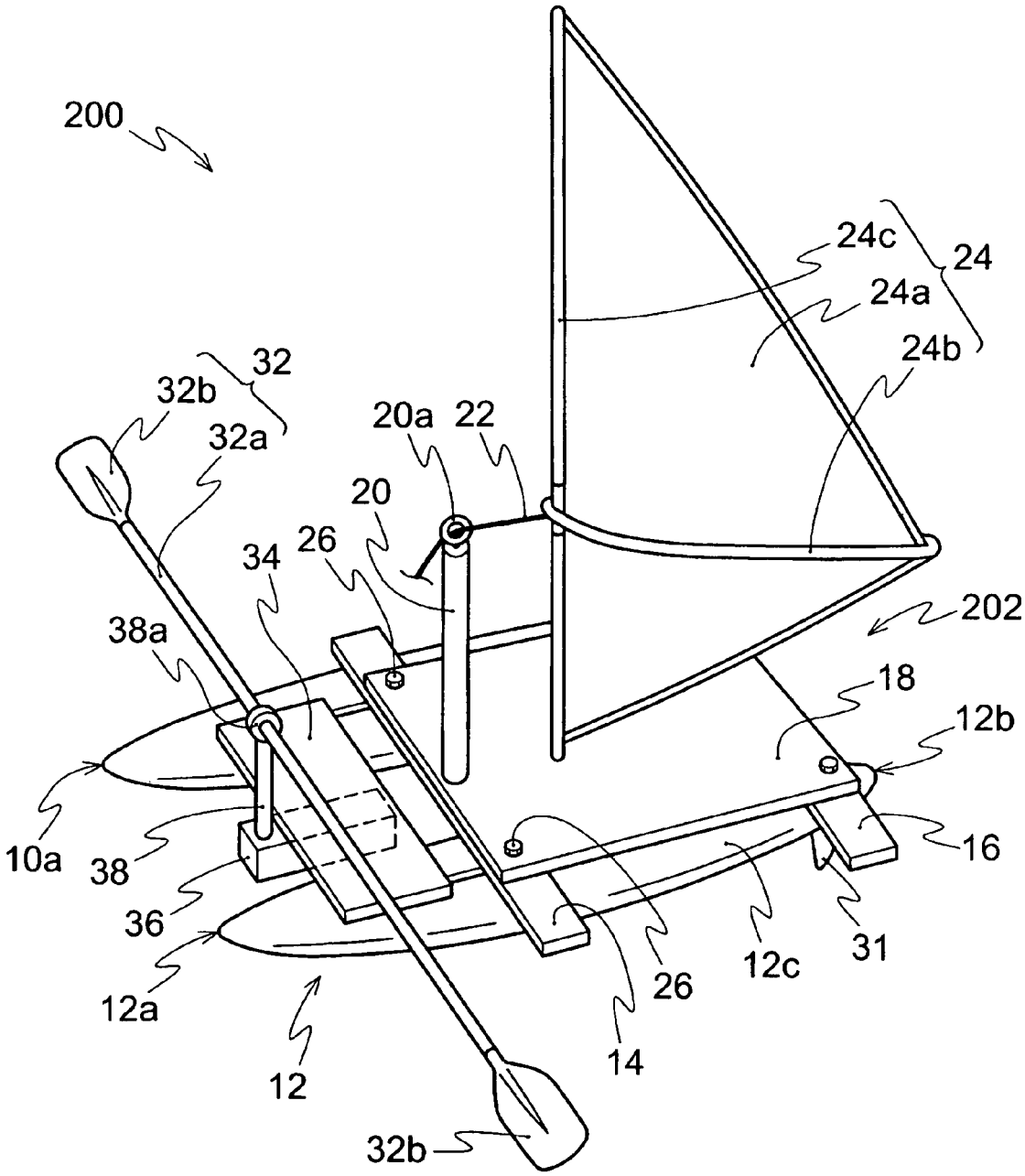
FIG. 5 is a view showing Embodiment 2 of the sailing board of the present invention.

FIG. 5 shows Embodiment 2 of a sailing board of the present invention. Detail explanations for the identical elements as explained in Embodiment 1 are omitted. The sailing board of the present Embodiment is the same as the sailing boards 100 of Embodiment 1 (FIGS. 1 to 4) except that a coupling member 202 for sailing boards 200 includes a paddle 32, second plate-like member 34, beam-shaped member 36, and rod-shaped member 38.

The paddle 32 has a shaft 32*a* and a pair of blades 32*b* provided at both sides of the shaft 32*a*. Therefore, even under no wind or slight wind when sailing is difficult, the user who has finished sailing can reach shore by setting down the sail 24 on the first plate-like member 18 through operating the paddle 32.

The second plate-like member is a place on which the user who is using the paddle 32 sits and is provided at the further front side of the front 10*a*, 12*a* relative to the first plate-like member 18. The beam-shaped member 36 is disposed between the surfboards 10, 12. The beam-shaped member 36 is mounted on a surface (not shown) which is opposite to the rod-shaped body 20 of the second plate-like member 34 by screwing a bolt member and nut member, for example.

The rod-shaped member 38 is erected by inserting an end thereof into the sides of the front 10*a*, 12*a* of the beam-shaped member 36. A second annular member 38*a* provided with a shaft 32*a* is formed at the leading edge of the rod-shaped member 38.

As mentioned above, the similar effects as obtained by Embodiment 1 can be achieved by the present Embodiment. Furthermore, even under no wind or slight wind when sailing is difficult, the user who has finished sailing can reach shore by setting down the sail 24*a* on the first plate-like member 18 through operating the paddle 32.

Figure 6:
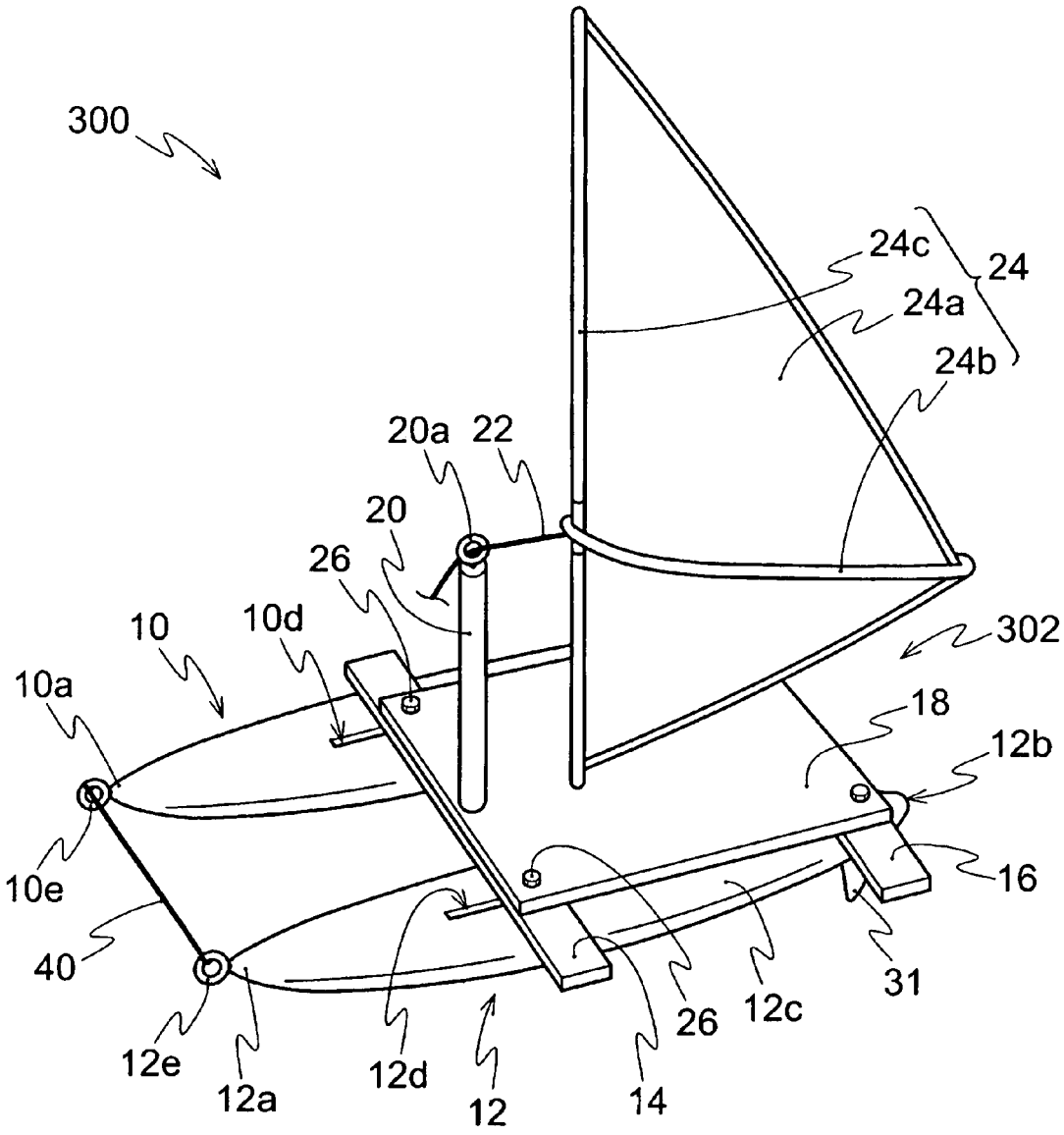
FIG. 6 is a view showing Embodiment 3 of the sailing board of the present invention.

FIG. 6 shows Embodiment 3 of the present invention. Detail explanations for the identical elements as explained in Embodiment 1 are omitted. The sailing board of the present Embodiment is the same as the sailing boards 100 of Embodiment 1 (FIGS. 1 to 4) except that a coupling member 302 used for sailing board 300 includes the pair of surfboards 10, 12 on which third annular members 10*e*, 12*e* for pulling the boards are formed respectively on the sides of the front 10, 12.

As described above, the similar effects as obtained by Embodiment 1 can be achieved by the present Embodiment. Furthermore, according to the present Embodiment, the surfboards 10, 12 can be jointed more rigidly as compared with the arrangement of Embodiment 1 by tying a rope 40 to the third annular members 10*e*, 12*e*.

Though the present invention is described above in detail, it is to be understood that the above-mentioned Embodiments and modifications thereof are only examples of the invention and the present invention is not limited to those. Various changes and modifications may be made without departing from the sprit and scope thereof.

INDUSTRIAL APPLICABILITY

According to the present invention, a twin sailing board, which substantially lowers the probability of falling down, facilitates sail up work, and is suitable for beginners to learn operating techniques, can be provided at a low cost. Furthermore, when the beginner develops skills and reaches intermediate/advanced level, a regular sailing board can be obtained by loosening the bolt member 26 to detach the coupling member 102 and mounting the mast 24*c* to the nut MT through the engaging portion 30.

The invention claimed is:

1. A twin sailing board characterized in comprising:

a pair of surfboards (10, 12) adjacently disposed in a lateral direction;

plate-like bodies (14, 16, 18) detachably secured to the surfboards (10, 12) by a screw (26), which is screwed with a mast end securing screw (MT) being movable in front and end directions of the surfboards (10, 12) within grooves (10*d*, 12*d*) provided on respective top surfaces of the pair of the surfboards (10, 12);

a rig (24) including at least a mast (24*c*), which is connected to assume any inclined attitude by an engaging portion (30) fixed at a substantially center of the plate-like bodies (14, 16, 18), a sail (24*a*) being set up on the mast (24*c*), and a boom (24*b*) circularly provided on the mast (24*c*) in such a manner that the sail (24*a*) is placed inbetween; and a rod-shaped member (20) erected on the plate-like bodies (14, 16, 18) at the further front side than the mast (24*c*) and whose leading edge is provided with a first ring member (20*a*).

2. The twin sailing board according to claim 1, wherein a second plate-like member (34) is secured at further front side than the plate-like bodies (14, 16; 18) of the pair of surfboards (10, 12), and a paddle (32) is pivotally secured to the second plate-like member (34) by a beam-shaped member (36).

* * * * *